United States Patent [19]

Leonas

[11] 3,958,696

[45] May 25, 1976

[54] PORTABLE HANGER DEVICE

[76] Inventor: John J. Leonas, 17417 Center Ave., E. Hazelcrest, Ill. 60429

[22] Filed: Apr. 30, 1973

[21] Appl. No.: 355,388

[52] U.S. Cl. ..... 211/45; 211/113

[51] Int. Cl.[2] ..... A47B 63/02

[58] Field of Search ..... 211/45, 46, 47, 48, 211/113, 119, 124; 248/359, 360; 312/184

[56] References Cited

UNITED STATES PATENTS

| | | | |
|---|---|---|---|
| 422,228 | 2/1890 | Kirtland | 211/45 X |
| 546,492 | 9/1895 | Millert | 211/45 UX |
| 655,981 | 8/1900 | Lietz | 211/46 |
| 1,240,611 | 9/1917 | Smith | 211/48 UX |
| 2,253,788 | 8/1941 | Kern | 312/184 X |
| 2,964,197 | 12/1960 | Wallace | 211/45 |
| 2,977,001 | 3/1961 | Vitale | 211/113 |
| 2,990,961 | 7/1961 | Schneider | 211/48 |
| 3,298,374 | 1/1967 | Grundell | 211/46 X |
| 3,684,340 | 8/1972 | Kirkorian | 312/184 X |
| 3,708,073 | 1/1973 | Davis | 211/47 |

FOREIGN PATENTS OR APPLICATIONS

| | | | |
|---|---|---|---|
| 824,927 | 12/1959 | United Kingdom | 312/184 |
| 6,401,219 | 2/1964 | Netherlands | 312/184 |
| 346,861 | 7/1960 | Switzerland | 312/184 |
| 791,345 | 2/1958 | United Kingdom | 211/46 |
| 1,934,112 | 1/1971 | Germany | 312/184 |

*Primary Examiner*—James T. McCall
*Assistant Examiner*—Thomas J. Holko
*Attorney, Agent, or Firm*—Ladas, Parry, Von Gehr, Goldsmith & Deschamps

[57] ABSTRACT

A portable hanger device for suspending articles, such as plans, drawings, catalogs, posters, and the like, particularly heavy and/or bulky sheet materials. A rigid support bar is mounted in an elongated plastic sleeve having a pair of depending plastic flanges to be secured to the article. A flexible coupling is attached to the midpoint of the bar. A hook is connected to the flexible coupling for horizontal suspension of the device. The flexible coupling between the bar and the hook enables the device to be rolled up within the article where the article itself is flexible sheet material.

2 Claims, 2 Drawing Figures

PORTABLE HANGER DEVICE

BACKGROUND OF THE INVENTION

The invention relates to an improved hanger device suitable for suspending large, bulky or heavy articles, and in particular sheet materials.

In the construction industry, plans, drawings or blueprints as well as specifications usually are rendered on large sheets having widths of from about 8 to 42 inches. Often a large number of such sheets are secured together for a particular purpose, resulting in an article of considerable weight, ranging from about 2 pounds up to about 30 pounds, for example.

While such plans, drawings or like materials, may be conveniently rolled up for storage, a large number of such rolls may be in use at one time. Identification of the material or articles ordinarily has required the user to unroll and re-roll the various plans or drawings until a particular one is located. This procedure is time consuming and leads to damage of the materials through repeated use. Conventional garment-type hangers are not suitable for suspending such plans, drawings or like articles, while being permanently attached thereto.

In addition, the problem of convenient storage of materials not in current use is one which is particularly critical in the construction industry where work space often is quite limited. Rolled up plans, specifications, and the like, often are simply stacked in piles or in filing drawers for want of adequate space or any organized storage means.

SUMMARY OF THE INVENTION

The present invention overcomes these problems in providing an improved hanger device suitable for convenient mounting of bulky, heavy materials, and permits ready identification of the articles and facilitates storage, either in an arrangement of suspended articles or rolled up in the more traditional manner.

Since the invention permits the articles to be rolled up between uses, complete portability is provided. Moreover the compact and partially flexible construction avoids interferences or inconvenience when the article itself is spread out for use.

The improved hanger device also is quite useful in display and/or storage of large maps, posters, X-rays, photographic negatives, and the like, either with single or multiple sheets.

Moreover, the invention can be used for suspending large bound volumes or catalogs due to the ability of accommodating relatively heavy loads without deformations.

DESCRIPTION OF THE PREFERRED EMBODIMENT

Figure 1:
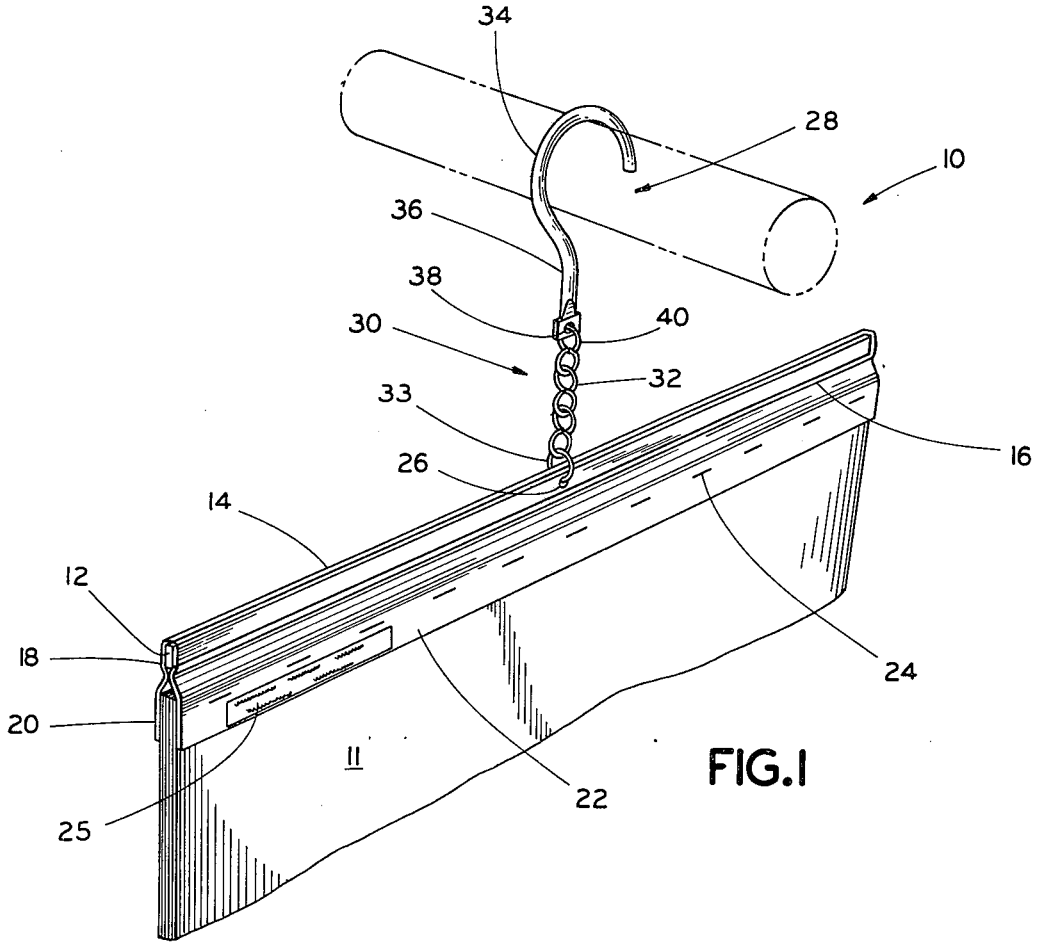
FIG. 1 is a schematic view of the improved hanger secured to an article and in suspended position.

Referring now to FIG. 1, there is shown a preferred embodiment of the improved hanger device 10 for suspending an article 11. The hanger device 10 is provided with a rigid support bar 12, which may be fabricated from ordinary steel bar stock, or which could be made of other rigid material such as wood, reinforced paperboard, plastic, or hardened rubber.

Surrounding the support bar 12 is a sleeve 14, preferably formed from an elongated rectangular transparent plastic sheet which is folded over along its length into a generally U-shaped configuration, and is heat sealed or otherwise suitably secured along a longitudinal seam 16 to provide a sleeve opening 18 to accommodate the support bar 12.

The remainder of the plastic sheet extending laterally from the sleeve portion 14 defines a pair of elongated flanges 20 and 22.

The flanges 20, 22 can be spread apart to the extent needed to receive an end portion of the article 11 to be suspended, with suitable fasteners such as staples 24 securing the flanges to the article. It will be understood that only a single flange is necessary for some applications, but that there must be at least a flange portion at or near each end of the bar for support of the article to be secured thereto. A pair of such flanges 20,22 normally would be preferred to prevent fraying or other damage to the end edge of the article being suspended. Further the flanges 20,22 could be made to extend the entire length of the article for more complete protection.

The use of transparent plastic material is particularly desirable for ready indentification of articles having indicia along the end margin being secured, but other material such as reinforced paper, molded rubber or plastic, or a metallic material could be employed for the flange or flanges to which the article is secured. In any case a suitable label 25 can be affixed to one flange for identification.

The support bar 12 is provided with an aperture 26 for receiving a hanger portion 28. The aperture 26 is formed at the mid-point of the length of the bar. Hanger portion 28 includes a flexible coupling 30 which preferably consists of a short length of chain having a plurality of links 32. It has been found that at least two such links are needed to provide sufficient flexibility for the purpose set forth below.

A link 33 at one end of the chain extends through the aperture 26 to provide a permanent but movable connection with the bar 12. Separate aligned apertures (not shown) are provided in the sleeve 14, which openings can be formed during assembly by piercing an open end of the link 33 through the plastic sleeve material, then passing the link through the aperture 26 in bar 12, and again piercing the link through the plastic material on the opposite side. Thereafter, link 33 is tightened to provide the permanent mounting to the bar 12.

The hanger portion 28 also includes a conventional hook 34 of any suitable configuration for hanging. The hook 34 has a base portion 36 provided with an aperture 38. A link 40 at the other end of the chain passes through the aperture 38 and is permanently secured to the hook 34 for limited movement relative thereto.

By providing at least two chain links 32 in the flexible coupling 30 there will be sufficient distance between the base 36 of the hook 34 and the bar 12, as well as sufficient mobility therebetween, to enable the hook and chain to be folded along the sleeve 14 and the bar 12.

Figure 2:
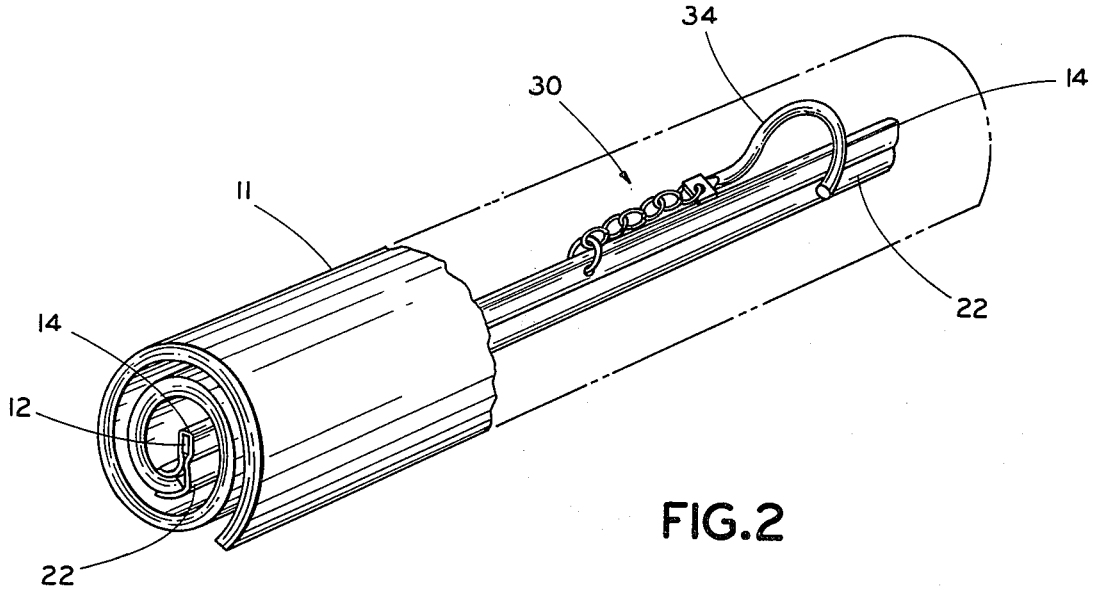
FIG. 2 is a schematic view of the improved hanger shown in FIG. 1, but with the device rolled within the article.

Thus, the entire hanger portion 28 can be conveniently rolled up within the article 11, as shown in FIG. 2, or can be simply folded out of the way when the article is spread out for use.

In one construction of the invention, a bar stock having a generally rectangular cross-section of about ⅛ inch by ¼ inch was cut into lengths of 24 inches, forming the support bar 12. Plastic sheet material 8 mils thick was utilized for the sleeve 14 encasing the bar 12 and stitched to provide 2 inch wide flanges 20,22. A conventional steel hook 34 was connected to each bar with a four link chain, each link being about ½ inch long.

It will be understood that rope, beaded material, rubber or other suitable flexible means could be utlized in place of the chain links 32. Furthermore, the invention contemplates the use of other materials for the rod and sleeve, such as hardened rubber, metal, reinforced paperboard or molded plastic.

What is claimed is:

1. A portable hanger device for suspending articles, such as plans, drawings, catalogs, posters, and the like, comprising an elongated rigid support bar, an article connecting member formed of a flexible synthetic plastic material having a sleeve surrounding said bar and a pair of elongated flanges integral with said sleeve and extending laterally from one side of the sleeve, said flanges being adapted to be permanently secured to respective opposite sides of an article to be suspended, said bar having an aperture at the midpoint thereof, said sleeve having a pair of opposed apertures in alignment with each other and the aperture in said support bar, and a flexible hanger connected to said support bar and article connecting member, said hanger being centrally disposed with respect thereto and comprising a length of chain having a plurality of links, one of said links passing through the apertures in said sleeve and said support bar, said one link being permanently coupled to said bar, and a hook having a base portion with an aperture extending therethrough, said length of chain having another link passing through said aperture in the base portion of said hook and being permanently secured thereto.

2. A device as defined in claim 1, wherein said article connecting member is formed of an elongated rectangular sheet of said flexible material, said sheet being folded back upon itself to provide a pair of substantially equal sheet portions which are secured together along a seam to form said sleeve and said pair of elongated flanges for attachment to said article.

* * * * *